US007588039B2

(12) United States Patent
Saito et al.

(10) Patent No.: US 7,588,039 B2
(45) Date of Patent: Sep. 15, 2009

(54) CLEANING SYSTEM OF A HAIR REMOVING APPARATUS

(75) Inventors: Atsuhiro Saito, Hikone (JP); Jyuzaemon Iwasaki, Nagahama (JP); Hiroyuki Kameoka, Hikone (JP); Yasuo Ibuki, Hikone (JP); Fumio Taniguchi, Hikone (JP); Kotaro Yanagi, Hikone (JP); Hiroshi Shigeta, Fujiidera (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 351 days.

(21) Appl. No.: 10/525,205

(22) PCT Filed: Jan. 19, 2004

(86) PCT No.: PCT/JP2004/000382

§ 371 (c)(1),
(2), (4) Date: Feb. 22, 2005

(87) PCT Pub. No.: WO2004/066780

PCT Pub. Date: Aug. 12, 2004

(65) Prior Publication Data

US 2006/0011225 A1 Jan. 19, 2006

(30) Foreign Application Priority Data

Jan. 21, 2003 (JP) ..... 2003-012812

(51) Int. Cl.
*B08B 3/00* (2006.01)

(52) U.S. Cl. ..... 134/201; 30/41; 30/DIG. 1; 206/208; 206/351

(58) Field of Classification Search ..... 134/201
See application file for complete search history.

(56) References Cited

U.S. PATENT DOCUMENTS 3,659,180 A * 4/1972 Urbush ..... 320/115

(Continued)

FOREIGN PATENT DOCUMENTS

CN 2342947 Y 10/1999

(Continued)

OTHER PUBLICATIONS

International Preliminary Report (PCT Form IB/373) PCT/JP2004/06382.

(Continued)

*Primary Examiner*—Michael Barr
*Assistant Examiner*—Jason P Riggleman
(74) *Attorney, Agent, or Firm*—Cheng Law Group PLLC

(57) ABSTRACT

A cleaning system for cleaning an operator head of a hair removing apparatus such as a dry shaver. The system includes a cleaning device having a housing configured to hold the shaver upside down to place the operator head in a basin for cleaning the same with a liquid supplied from a tank. The apparatus incorporates an externally controllable electric circuit for driving the operator head in accordance with an external electric signal generated by a controller within the device. The device's housing has a signal transmitting means for transmitting the electric signal, while the apparatus has a signal receiving means which comes into electrical interconnection with the signal transmitting means. The signal receiving means is disposed intermediate the height of the apparatus such that the electrical interconnection can be made within the height of the apparatus, requiring no extra height dimension to the system for the electrical interconnection.

1 Claim, 13 Drawing Sheets

U.S. PATENT DOCUMENTS

| | | | | |
|---|---|---|---|---|
| 4,092,580 | A | 5/1978 | Prinsze | |
| 5,711,328 | A * | 1/1998 | Braun | 134/111 |
| 5,828,966 | A | 10/1998 | Davis et al. | |
| 6,263,890 | B1 | 7/2001 | Hoser | |
| 6,305,391 | B1 | 10/2001 | Höser | |
| 6,313,604 | B1 | 11/2001 | Chen | |
| 6,531,873 | B1 | 3/2003 | Wohlrabe | |
| 7,150,285 | B2 * | 12/2006 | Saito et al. | 134/100.1 |

FOREIGN PATENT DOCUMENTS

| | | | |
|---|---|---|---|
| CN | 1244101 | A | 2/2000 |
| EP | 1 054 261 | A2 | 11/2000 |
| JP | 57-145684 | A1 | 9/1982 |
| JP | 5234763 | * | 9/1993 |
| WO | WO-03/099060 | A1 | 12/2003 |

OTHER PUBLICATIONS

Written Opinion of the International Searching Authority (PCT Form ISA/237) dated Jun. 17, 2004.

International Search Report for PCT/JP2004/00382 mailed on Jun. 17, 2004.

Chinese Office Action for corresponding Application No. 2004800007823 dated Mar. 9, 2007 with English Translation.

* cited by examiner

CLEANING SYSTEM OF A HAIR REMOVING APPARATUS

TECHNICAL FIELD

The present invention is directed to a cleaning system of a hair removing apparatus, particularly a dry shaver with the use of a cleaning liquid.

BACKGROUND ART

U.S. Pat. No. 5,711,328 shows a cleaning system of a dry shaver having a cleaning device. The device is formed at its lower end with a basin for accommodating therein a shaver head of the shaver, and a tank containing a volume of a cleaning liquid and communicating with the basin through a liquid supply channel. A pump is provided to supply the liquid from the tank into the basin for cleaning the shaver head, i.e., cutters and the associated parts. The dry shaver is elongated in shape to have the shaver head at its top end and an electric port at the opposite bottom end. When cleaning the shaver head, the shaver is held on the housing upside down with the shaver head placed into the basin. The housing is provided with an electric terminal to give an electric signal to the dry shaver in order to drive the shaver head while circulating the liquid from the tank to the basin for enhancing the cleaning effect. The electric terminal is made for connection with the electric port at the bottom of the shaver. For this purpose, the housing is provided with a vertical stand carrying the electric terminal at its upper end for connection with the electric port of the shaver held upside down by the housing. Thus, the portion of the vertical stand carrying the electric terminal adds an extra height dimension to the housing, in addition to making itself as a hindrance to the placement of the shaver upside down on the housing, thereby detracting from the compactness of the whole system as well as the convenience.

DISCLOSURE OF THE INVENTION

The present invention has been achieved in view of the above problems to provide an improved cleaning system composed of a hair removing apparatus and a cleaning device for cleaning an operator head of the apparatus. The apparatus has a height and carries at its top end an operator head. The apparatus incorporates an externally controllable electric circuit for driving the operator head and/or charging the apparatus in accordance with an external electric signal. The cleaning device includes a housing configured to hold the apparatus upside down, a basin formed in the housing for accommodating therein the operator head. A tank is provided on the housing to contain a volume of a cleaning liquid. The cleaning device includes a supplying means for supplying the cleaning fluid from the tank to the basin for cleaning the operator head, and includes a controller for activating the supplying means as well as for providing the electric signal. The housing is formed with a signal transmitting means for transmitting the electric signal, while the hair removing apparatus has a signal receiving means which comes into electrical interconnection with the signal transmitting means for giving the electric signal to the electric circuit when the apparatus is held by the housing. The important feature of the present invention resides in that the signal transmitting means is disposed at a portion of the housing upwardly of the basin, and that the signal receiving means is disposed intermediate the height of the apparatus. Thus, the mechanism or parts for the electrical connection between the signal transmitting means and the signal receiving means can be located within the height of the apparatus being held by the housing of the device, and therefore add no extra height dimension to the combination of the device and the apparatus, thereby making the whole system compact sufficient to be installed in a limited space.

In a preferred embodiment, the signal receiving means is composed of terminal pads formed on the exterior of an apparatus's casing, and the signal transmitting means is realized by a set of contacts exposed on an exterior of the housing for pressed contact with the terminal pads, respectively.

Alternatively, the signal transmitting means is composed of a primary winding that is concealed within the housing and is electromagnetically coupled to a secondary winding held within the apparatus. The primary winding is electrically coupled to the controller, while the secondary winding is electrically coupled to the electric circuit of the apparatus and defines the signal receiving means. The primary and secondary windings can be therefore concealed respectively within the apparatus's casing and the device's housing to establish contact-free transformer coupling.

Preferably, the housing is provided with holding means which holds the apparatus in a position where the signal transmission means is kept in electrical interconnection with the signal receiving means, insuring the electrical interconnection.

For establishing a reliable electrical interconnection between the device and the apparatus, the holding means is preferred to include a mechanism that gives a bias for urging the signal transmitting means towards the signal receiving means. That is, the mechanism may be in the form of a pulling unit that pulls the apparatus towards the housing, or in the form of a pushing unit that pushes the apparatus against the housing.

Further, the housing may be shaped to have a bearing surface for bearing the apparatus. The bearing surface is inclined with respect to a height axis of the housing and is provided with a stopper for engagement with a portion of the apparatus such that the apparatus is guided along the inclined bearing surface and develops the bias force by its own weight when it is engaged with the stopper.

These and still other advantageous features of the present invention will become more apparent from the following description of the preferred embodiment when taken in conjunction with the attached drawings.

BEST MODE FOR CARRYING OUT THE INVENTION

Figure 1:
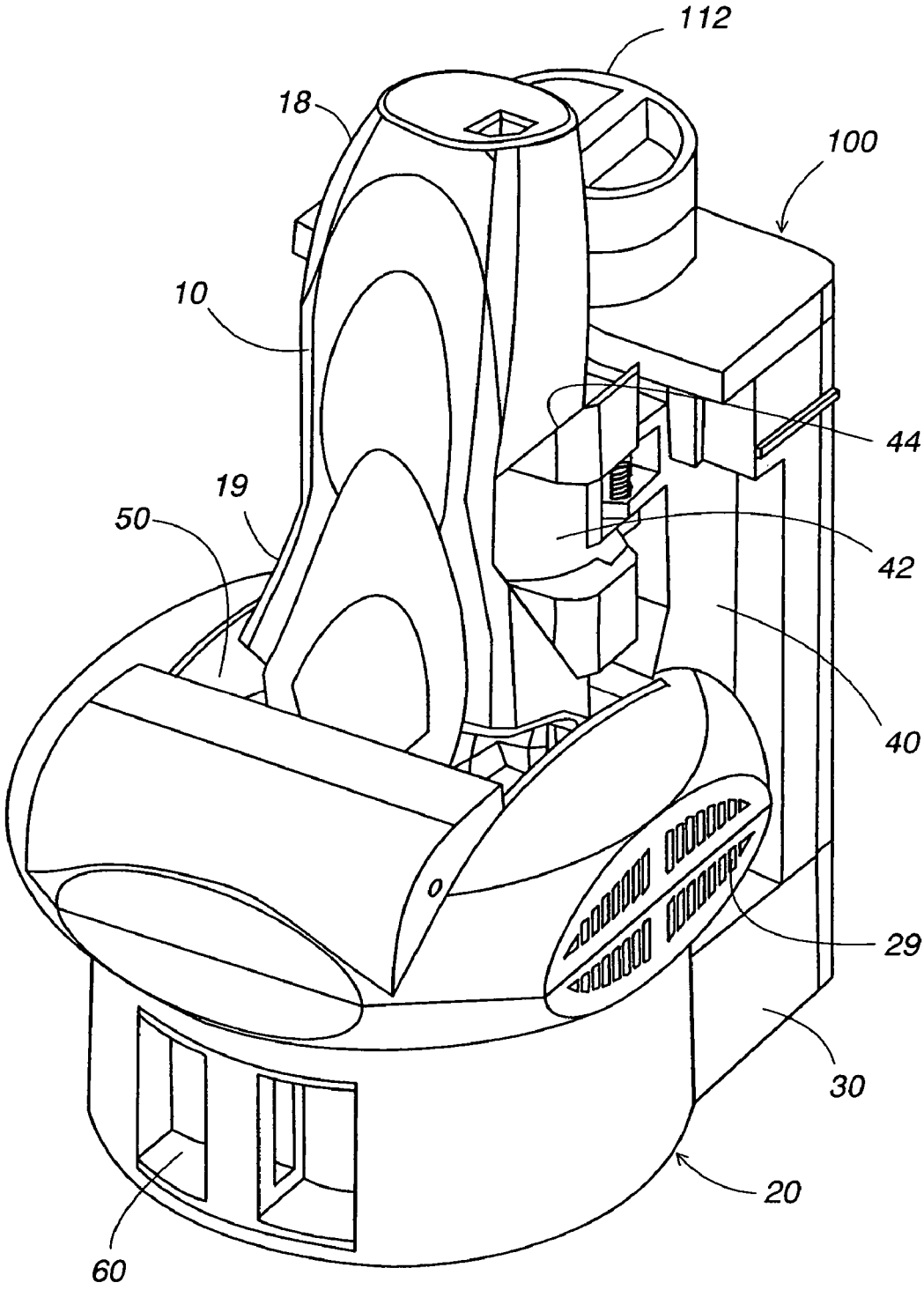
FIG. 1 is a perspective view of a cleaning system shaver in accordance with a preferred embodiment of the present invention.
Figure 2:
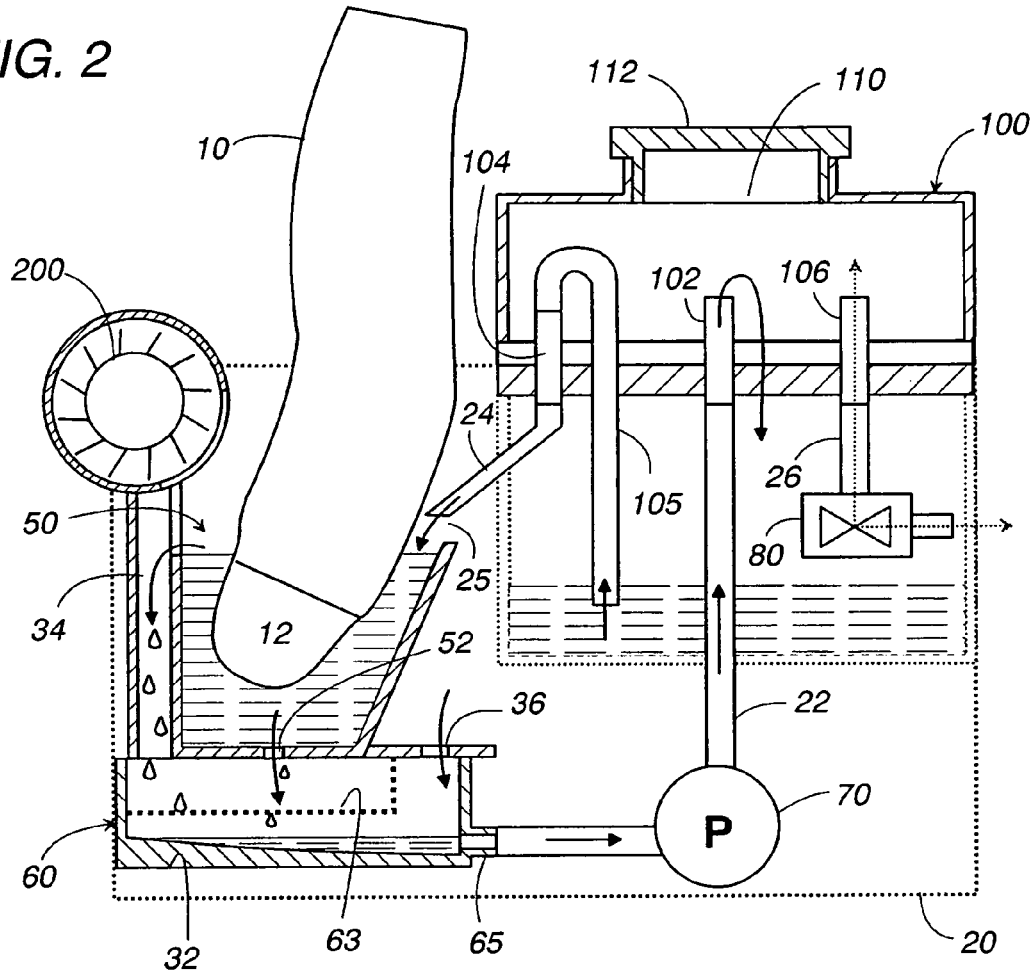
FIG. 2 is a schematic view illustrating the operation of the above system.

Referring now to FIGS. 1 and 2, there is shown a cleaning system for cleaning a hair removing apparatus, for example, a dry shaver 10 or epilator with the use of a cleaning liquid. The system includes a cleaning device which has a housing 20 with a base 30 and a stand 40 upstanding from a rear end of the base. Formed at the front end of the base 30 is a basin 50 which is configured to receive an operator head, i.e., a shaver head 12 of the shaver 10. The cleaning liquid is stored in a tank 100 detachably mounted to the stand 40 and is connected to the basin 50 for supplying the liquid into the basin and for recovering the liquid therefrom. The device includes a pump 70 which is controlled to circulate the cleaning liquid between the tank 100 and the basin 50 for cleaning the shaver head 12. The cleaning operation continues for a predetermined period. Thereafter, a control is made to collect the liquid from the basin 50 into the tank 100, details of which will be discussed later. Upon recovery of the liquid into the tank, a fan 200 is actuated to produce a forced air flow over the head 12 for drying the same.

Figure 9:
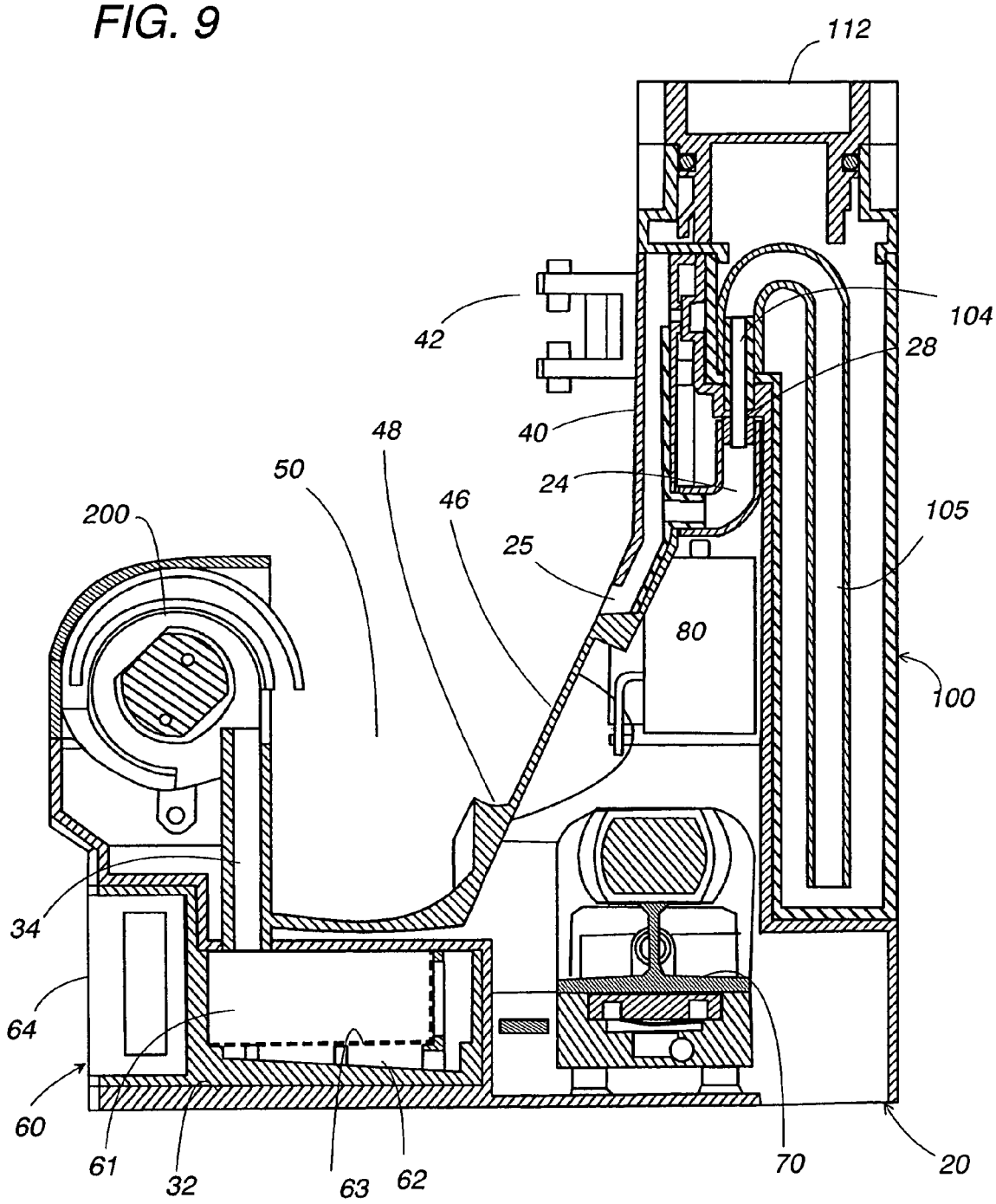
FIG. 9 is another vertical section of the above system.

As shown in FIG. 2, a drip pan 60 is disposed immediately below the basin 50 for collecting the liquid dripping and/or overflowing from the basin 50. The drip pan 60 has a top opening which communicates with a drain port 52 at the bottom center of the basin 50, and also with an overflow duct 34 leading to an upper edge of the basin 50. The drip pan 60 has a filter 63 for entrapping contaminants dislodged from the shaver head 12 and carried on the liquid dribbling through the drain port 52 into the drip pan 60. The liquid thus cleared of the contaminants is fed through a connection port 65 to a fluid intake channel 22 leading to the tank 100. The pump 70 is disposed in the fluid intake channel 22 for drawing the liquid from the basin 50. The fluid intake channel 22 is open to the atmosphere through the drain port 52, the overflow duct 34, and also through an air vent 36 formed in the base 30 around the basin 50. Thus, depending upon the level of the liquid in the basin 50, the outside air is drawn alone or together with the liquid by the action of the pump 70 into the tank 100 through the fluid intake channel 22. The tank 100 is provided in the form of a hermetically sealed container having an inlet and an outlet. The inlet is defined by a fluid inlet tube 102 which is detachably connected to the fluid intake channel 22 for taking in the liquid and/or the air. The outlet is defined by a liquid outlet tube 104 which is detachably connected to a liquid supply channel 24 formed in the housing 20 and leading to a spout 25 upwardly of the basin 50, as best shown in FIG. 9, for flowing the liquid down into the basin 50. Turning back to FIG. 2, the liquid outlet tube 104 is connected to a U-shaped sucking tube 105 which extends deep into the tank 100 to a point adjacent to the bottom of the tank for sucking the liquid. Further, the tank 100 is formed with an air exhaust tube 106 detachably connected to an air exhaust channel 26 which extends within the housing 20 and is open to the atmosphere through ventilation windows 29 or clearances in the walls of the housing 20. An air valve 80 is disposed in the air exhaust channel 26 to selectively close the tank and open it to the atmosphere. The air valve 80 is realized by a normally-closed electromagnetic valve which opens upon being energized or supplied with an electric current. A cap 112 is detachably and sealingly mounted in a filling port 110 in the upper end of the tank 100 for replacing or replenishing the liquid.

Figure 5:
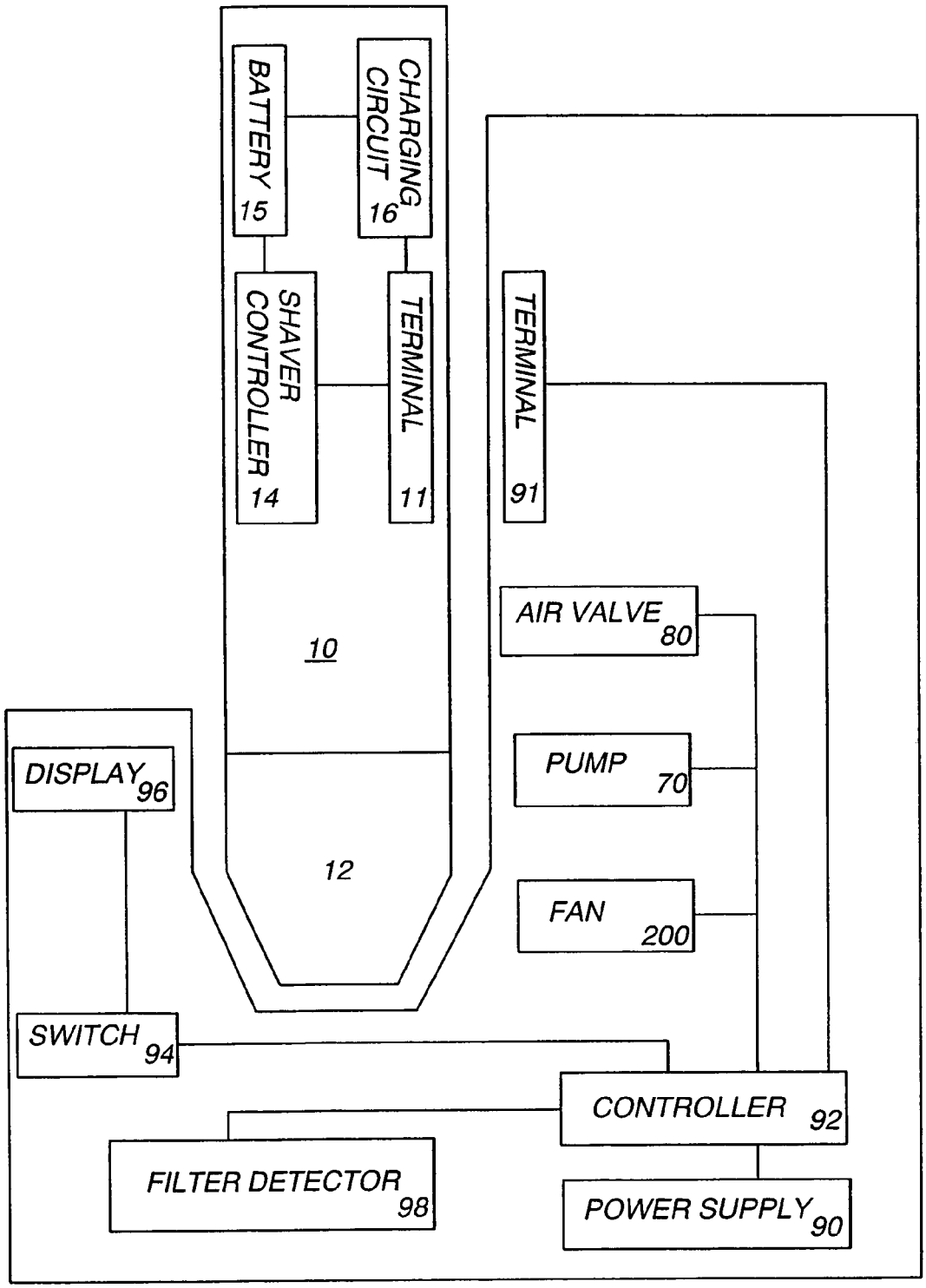
FIG. 5 is a circuit block diagram of the above device illustrating the operation of the above system.

Now, the operation of the device is discussed with reference to FIGS. 2 and 5. The device includes a power supply 90 providing an electric power to various electrical parts, and a controller 92 responsible for controlled operations of the associated parts. When a switch 94 is activated, the controller 92 responds to provide a supply mode and a recovery mode in sequence. In the supply mode, the pump 70 is activated with the air valve 80 being kept closed, i.e., the tank being kept hermetically sealed. Initially, the basin 50 is substantially free from the liquid such that only the air is drawn and accumulated in the tank 100 to increase the inside air pressure. As the air pressure increases, the liquid in the tank 100 is forced to expel out through the liquid outlet tube 104 and the liquid supply channel 24 into the basin 50. In this connection, it is noted that the drain port 52 of the basin 50 is dimensioned such that the flow rate of the liquid dripping into the drip pan 60 is smaller than that of the liquid being supplied from the tank 100, thereby increasing the amount of the liquid in the basin 50. After the basin 50 is filled with the liquid, an extra amount of the liquid is caused to overflow into the drip pan 60, maintaining the liquid in the basin 50 at a constant level. In this connection, the air is continuously drawn into the tank with the superfluous liquid to keep supplying the liquid into the basin 50, i.e., circulating the liquid between the tank 100 and the basin 50 for cleaning the shaver head 12. The supply mode continues over a predetermined time period during which the shaver head is activated intermittently or continuously to shake the contaminants off, enhancing the cleaning effect.

The supply mode is automatically followed by the recovery mode in which the pump 70 is activated with the air valve 80 kept opened to collect the liquid from the basin 50 through the drip pan 60 into the tank 100. With the air valve 80 being opened, i.e., the tank 100 opened to the atmosphere, the air drawn by the pump 70 is exhausted through the air valve 80 so as to recover the liquid and collect only the liquid in the tank 100. The recovery mode continues over a predetermined time period to collect the whole liquid into the tank. Near the end of the period, the shaver head is controlled to be activated for shaking the liquid off. Thereafter, the fan 200 is activated to dry the shaver head with or without the shaver head being actuated. Thus, the supply mode and the recovery mode are accomplished with the use of a single pump and the air valve.

Figure 3:
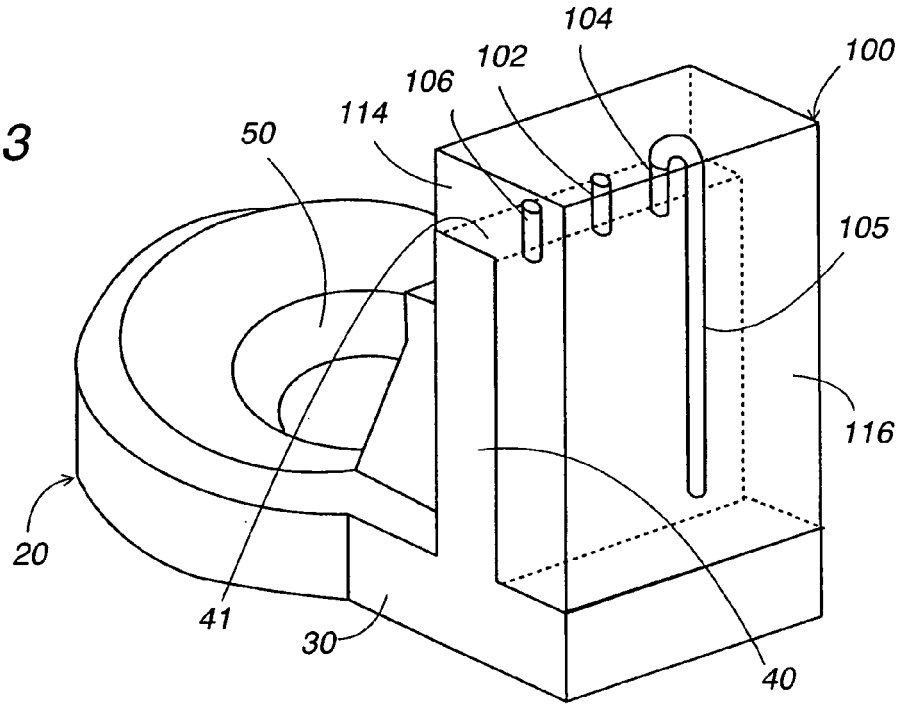
FIG. 3 is a rear perspective view of the system in a rather schematic representation.
Figure 10:
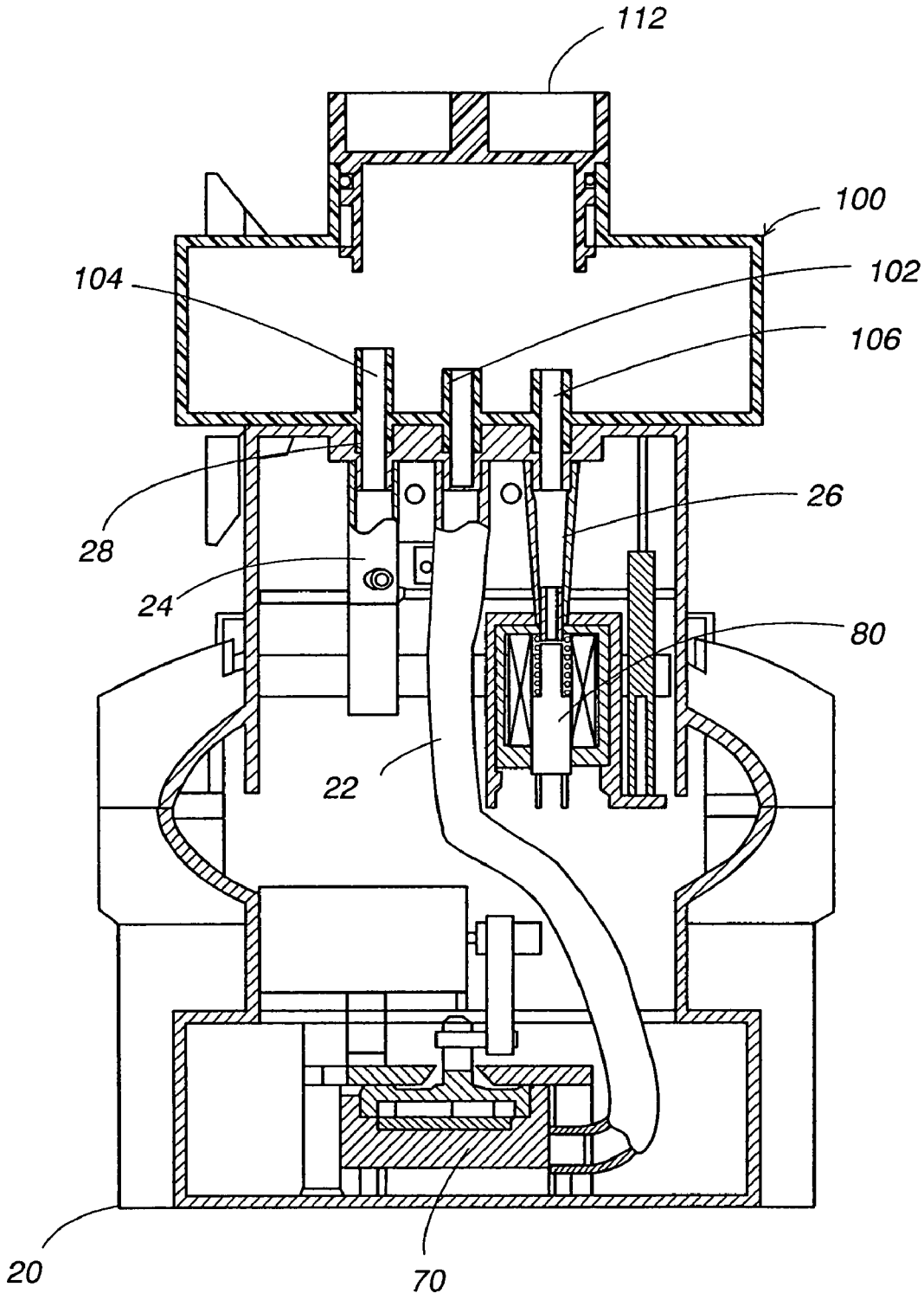
FIG. 10 is a rear vertical section of the above system.
Figure 11:
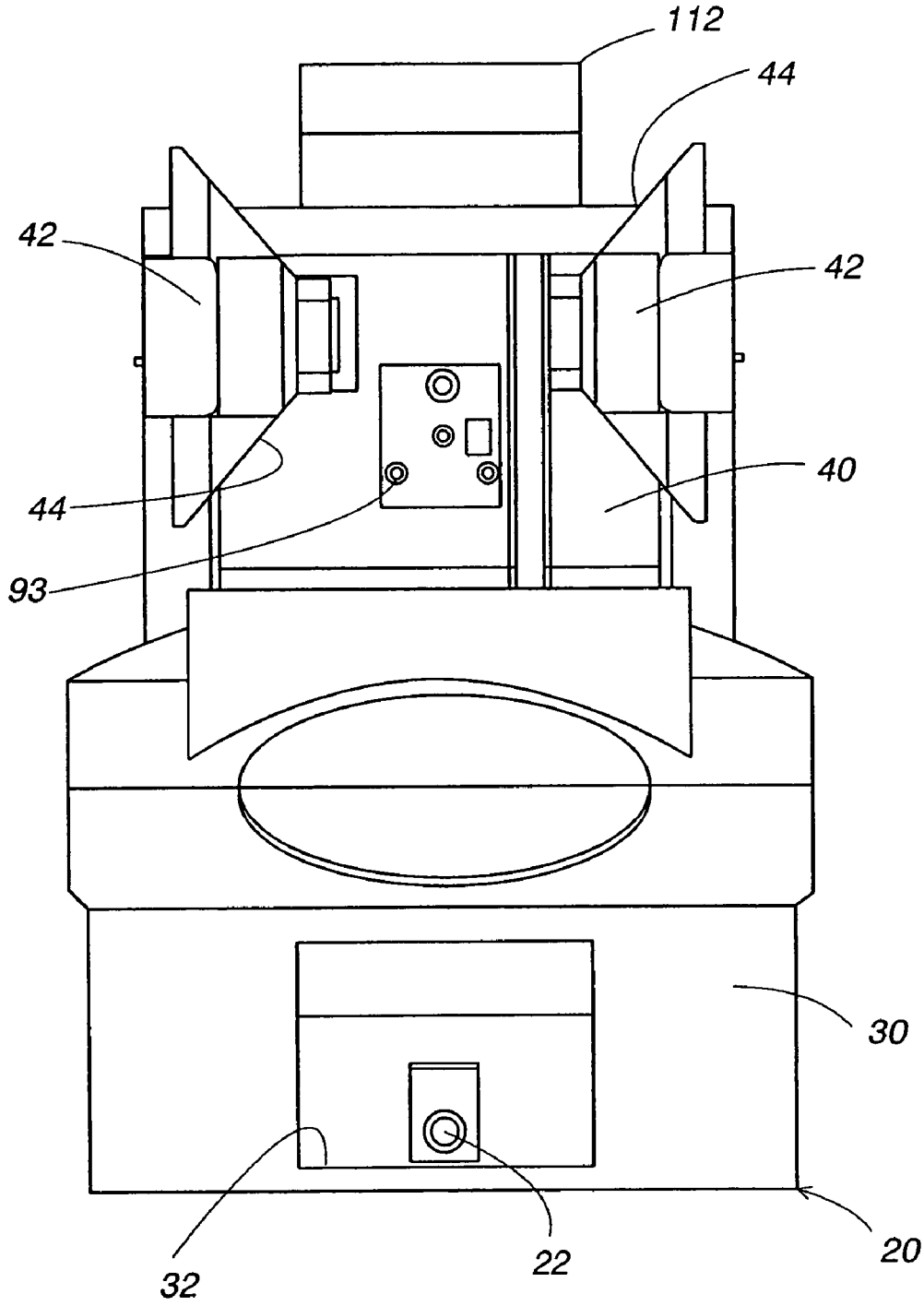
FIG. 11 is a front view of the above system.
Figure 12:
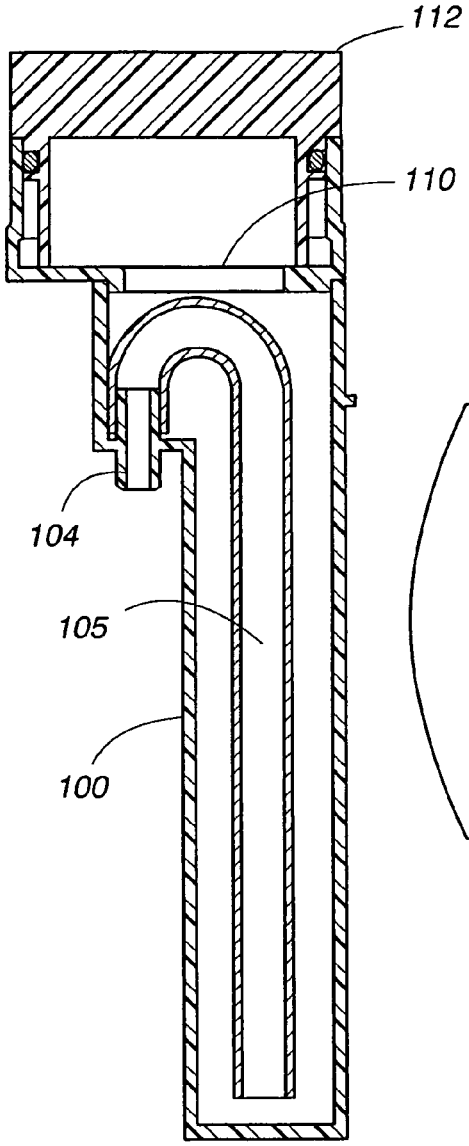
FIG. 12 is a vertical section of a detachable tank utilized in the above system.
Figure 13:
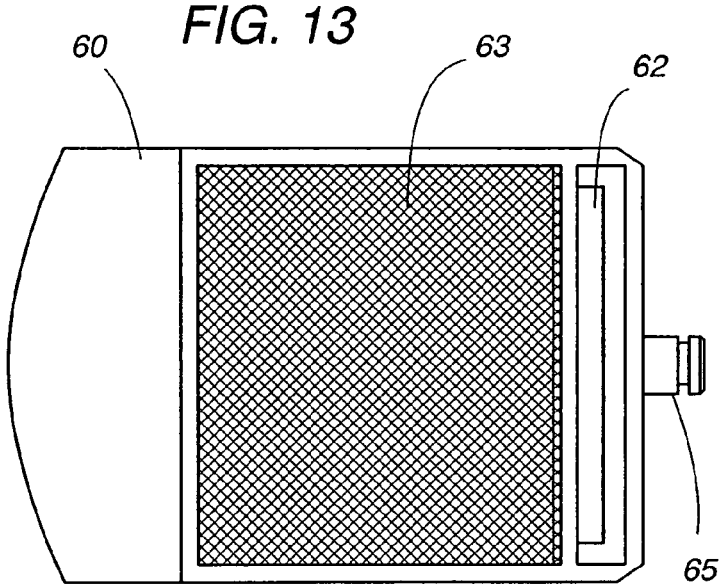
FIG. 13 is a top view of a drip pan utilized in the above system.

As schematically shown in FIG. 3, the tank 100 is L-shaped to have a wide header section 114 and a vertically elongated section 116 overlapping the rear face of the stand 40. The tank 100 is mounted on the housing 20 with the horizontal section 114 resting on a mounting face 41 on top of the stand 40. The fluid inlet tube 102, the liquid outlet tube 104, and the air exhaust tube 106 are integrally formed with the tank 100 to project on the bottom of the header section 114 for detachably connection with the fluid intake channel 22, the liquid supply channel 24, and the air exhaust channel 26, respectively. For this purpose, the ends of the channels 22, 24, and 26 are integrated into a combination socket 28 formed in the mounting face 41, as shown in FIG. 10. Thus, the tank 100 can be attached to the housing 20 from the above.

Figure 6:
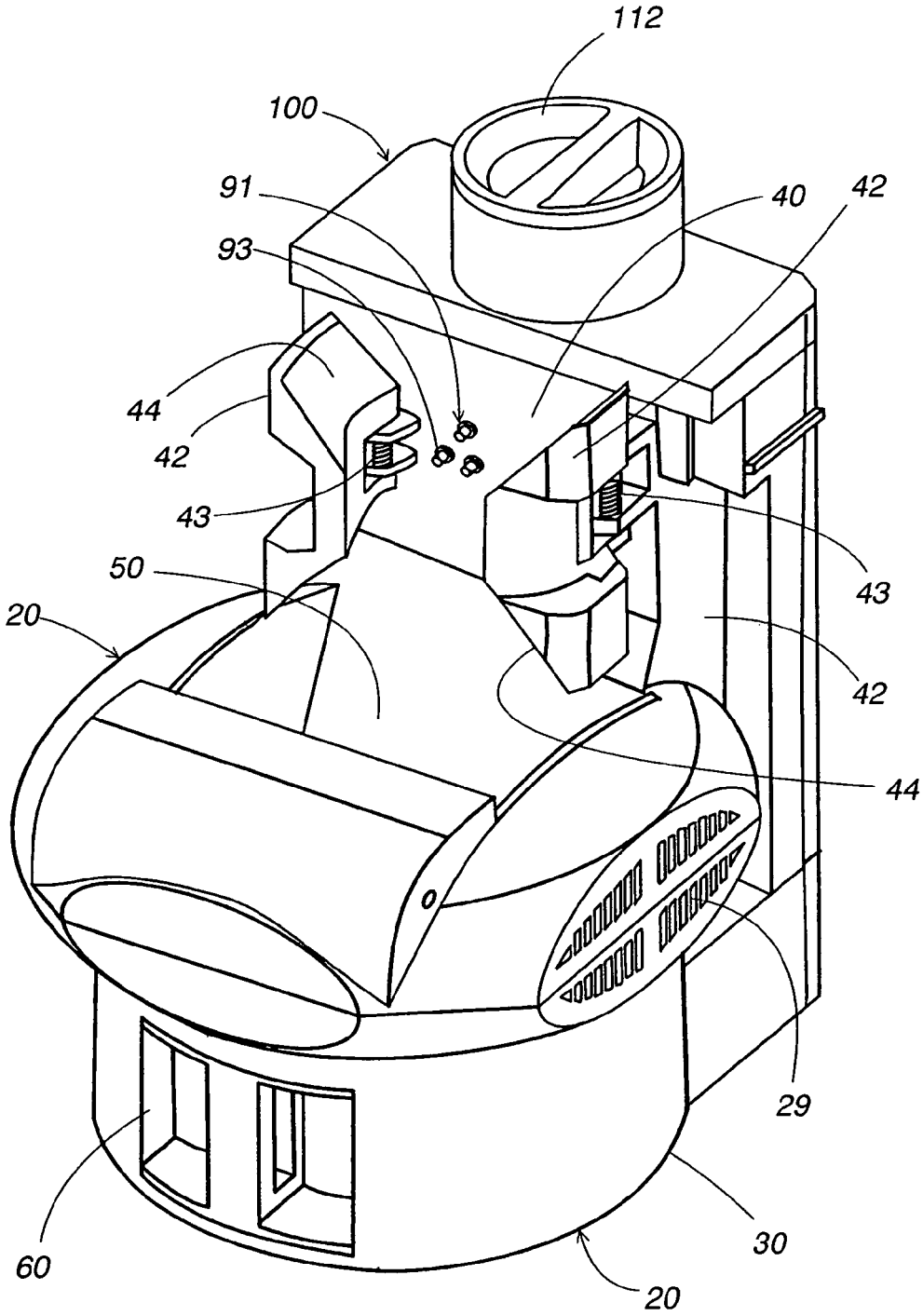
FIG. 6 is a front perspective view of the above system with the dry shaver being removed therefrom.
Figure 7:
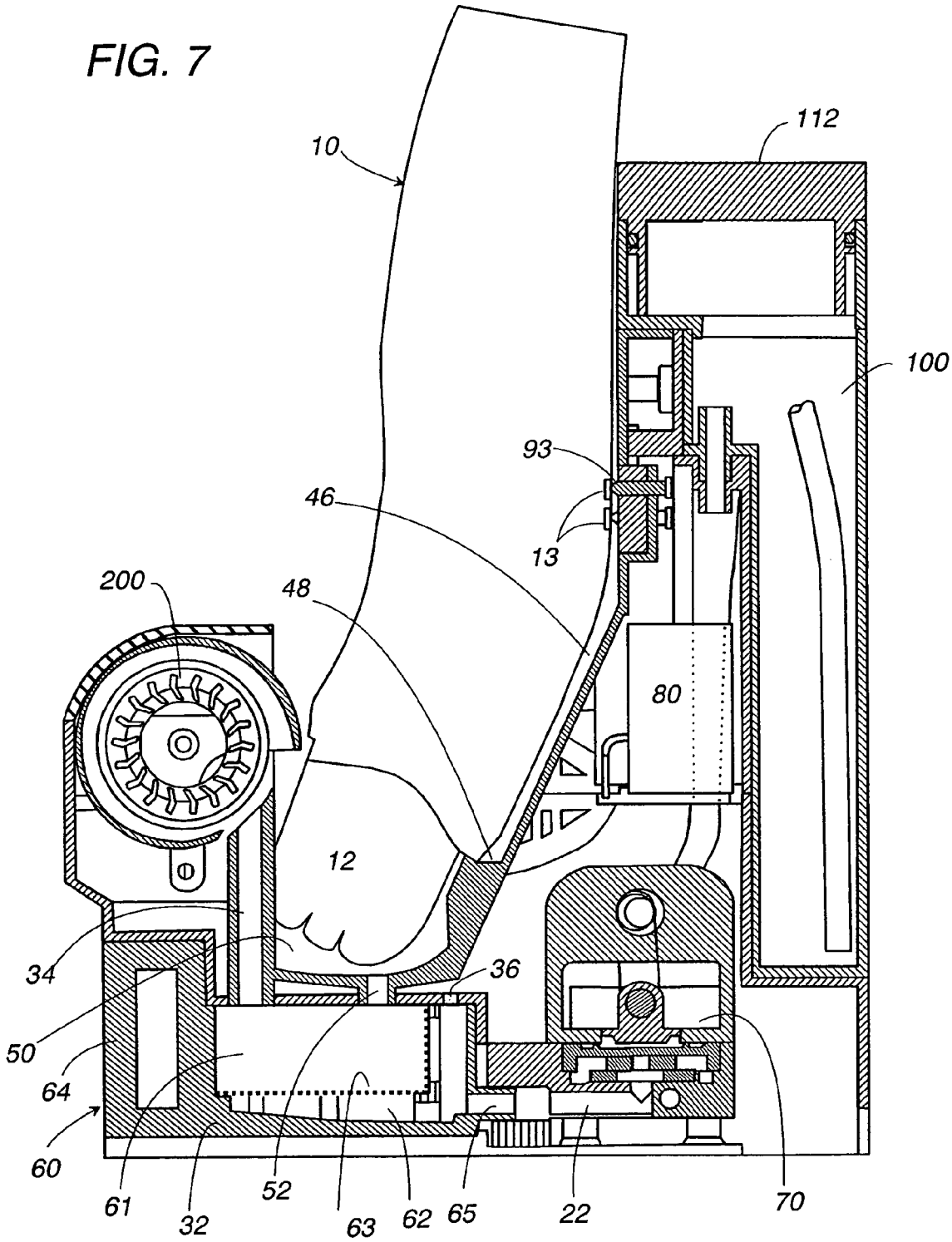
FIGS. 7 and 8 are vertical sections of the above system, respectively with and without the shaver.

The device further includes a filter detector 98 which issues a stop signal when the drip pan 60 is not in position below the basin 50. In response to the stop signal, the controller 92 deactivates the pump 70 and the associated parts to cease the above operation. A display 96 is included in the device to give information about which one of the supply mode and the recovery mode is proceeding, and the elapsed time. Further, a signal transmitting terminal 91 is provided on the side of the housing 20 for transmitting an electric signal that is received in a shaver controller 14 to activate the shaver head 12 or a charging circuit 16 for charging a battery 15. As best shown in FIGS. 6 and 7, the terminal 91 includes a set of contacts 93 exposed on the front wall of the stand 40 for contact with a corresponding set of pads 13 formed on the exterior of the shaver 10. The pads define a signal receiving terminal 11 represented in FIG. 5 through which the signal is transmitted to the shaver controller 14. The contacts 93, i.e., the terminal 91 is located intermediate the height of the stand 40 for intimate contact with the pads 13 or the receiving terminal 11 when the shaver 10 is held upside down to place the shaver head 12 into the basin 50.

Figure 15:
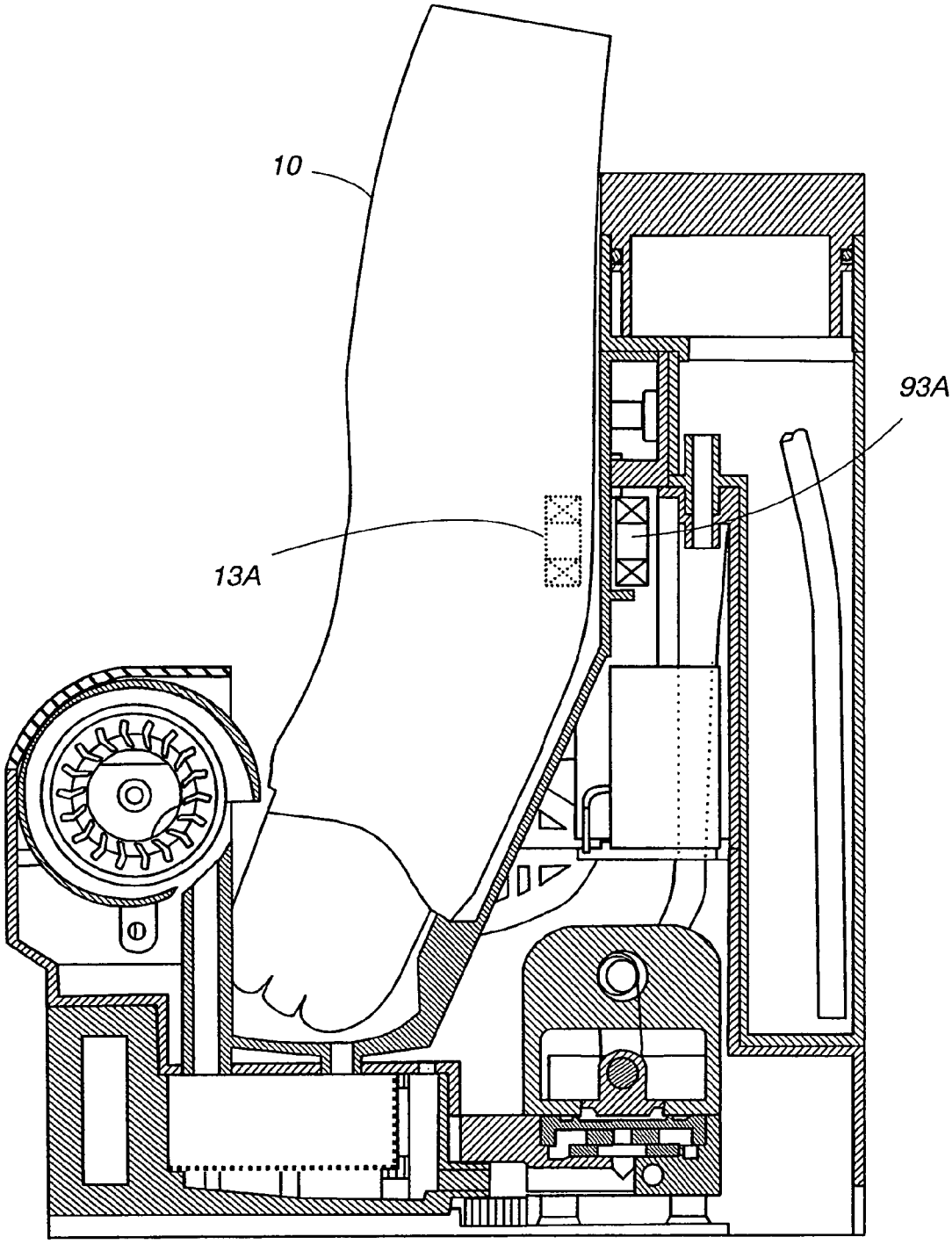
FIG. 15 is a vertical section of a cleaning device in accordance with a modification of the above embodiment.

Alternatively, as shown in FIG. 15, the housing 20 may include the signal transmitting terminal in the form of a primary winding 93A for transformer coupling with a secondary winding 13A placed within the shaver as the signal receiving terminal. In this modification, both of the windings can be concealed within the housing and shaver, respectively.

Figure 4:
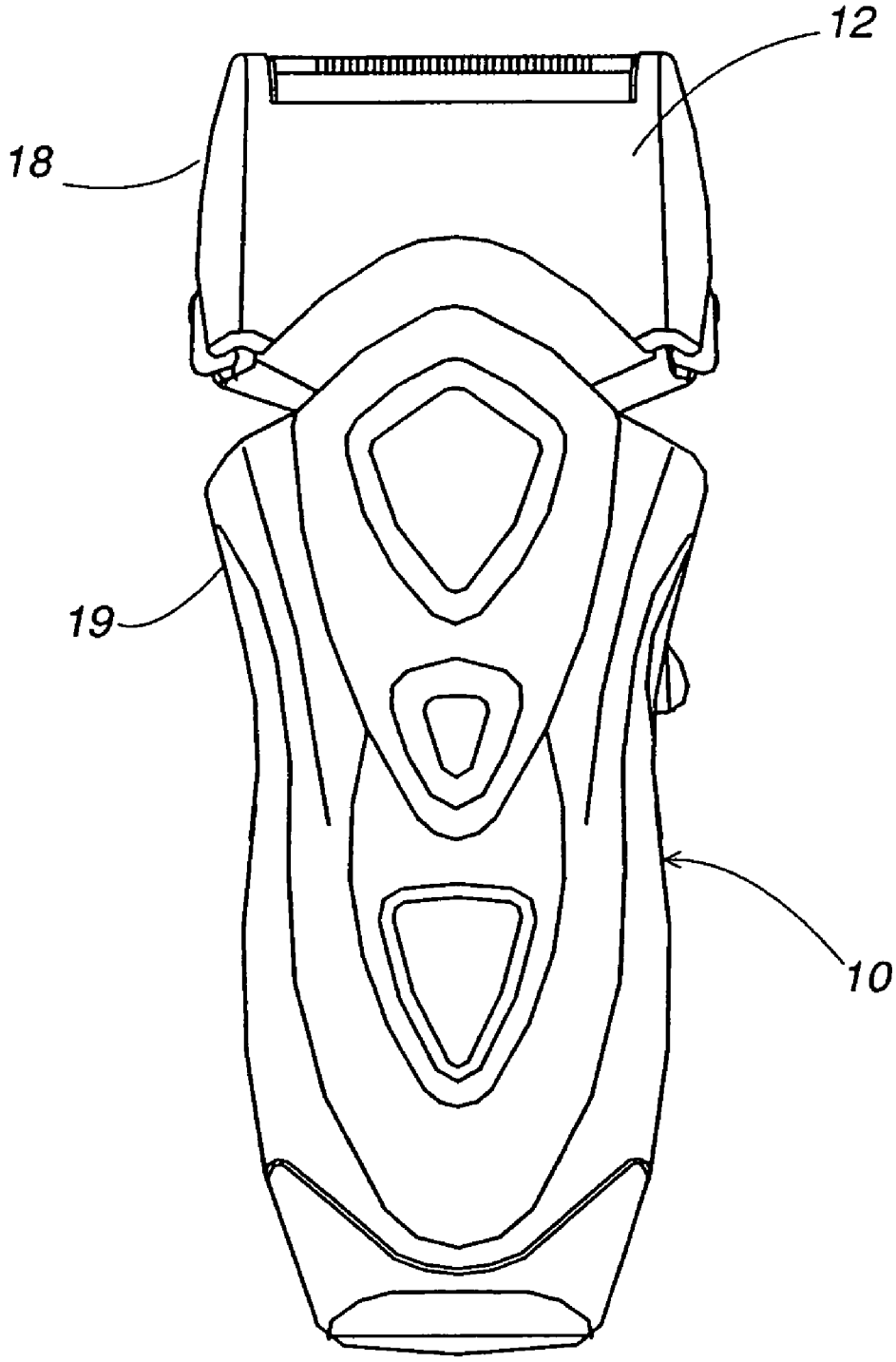
FIG. 4 is a front view of a dry shaver of the above system.

As shown in FIG. 6, the stand 40 carries a holding means, i.e., a mechanism of holding the shaver 10 in position. The mechanism includes a pair of clasps 42 which are spaced widthwise with respect to the height dimension of the housing 20 and are pivotally supported to the stand 40 to be movable between a holding position of bracing the shaver 10 and a releasing position permitting the removable of the shaver. The clasps 42 are biased by coil springs 43 to the holding position in which the clasps 42 engage the opposite sides of the shaver 10. Each of the clasps 42 is formed at its upper and lower end respectively with inclined guides 44 for sliding contact with tapered head sides 18 as well as top tapered sides 19 adjacent to the shaver head 12, as shown in FIG. 4. Thus, the clasps 42 can be forced to open temporarily in the release position when the shaver is moved vertically to place the shaver head 12 into the basin 50, allowing the easy attachment of the shaver, after which the clasps close by the action of the springs into the holding position. Also, when the shaver is moved vertically to pull the shaver head 12 out of the basin 50, the clasps 42 are forced to open by contact with the top tapered sides 19 of the shaver, permitting the easy detachment of the shaver from the device. In the holding position, the clasps 42 urges the shaver 10 towards the stand 40 in order to keep the pads 13 of the receiving terminal 11 pressed against the corresponding contacts 93 for reliable signal transmission therebetween. In this embodiment, the clasps 42 establishes a pulling unit that pulls the apparatus 10 towards the stand 40, i.e., a portion of the housing 20 opposed to the apparatus under the bias of the springs 43 for reliable electrical interconnection between the apparatus 10 and the device.

Figure 8:
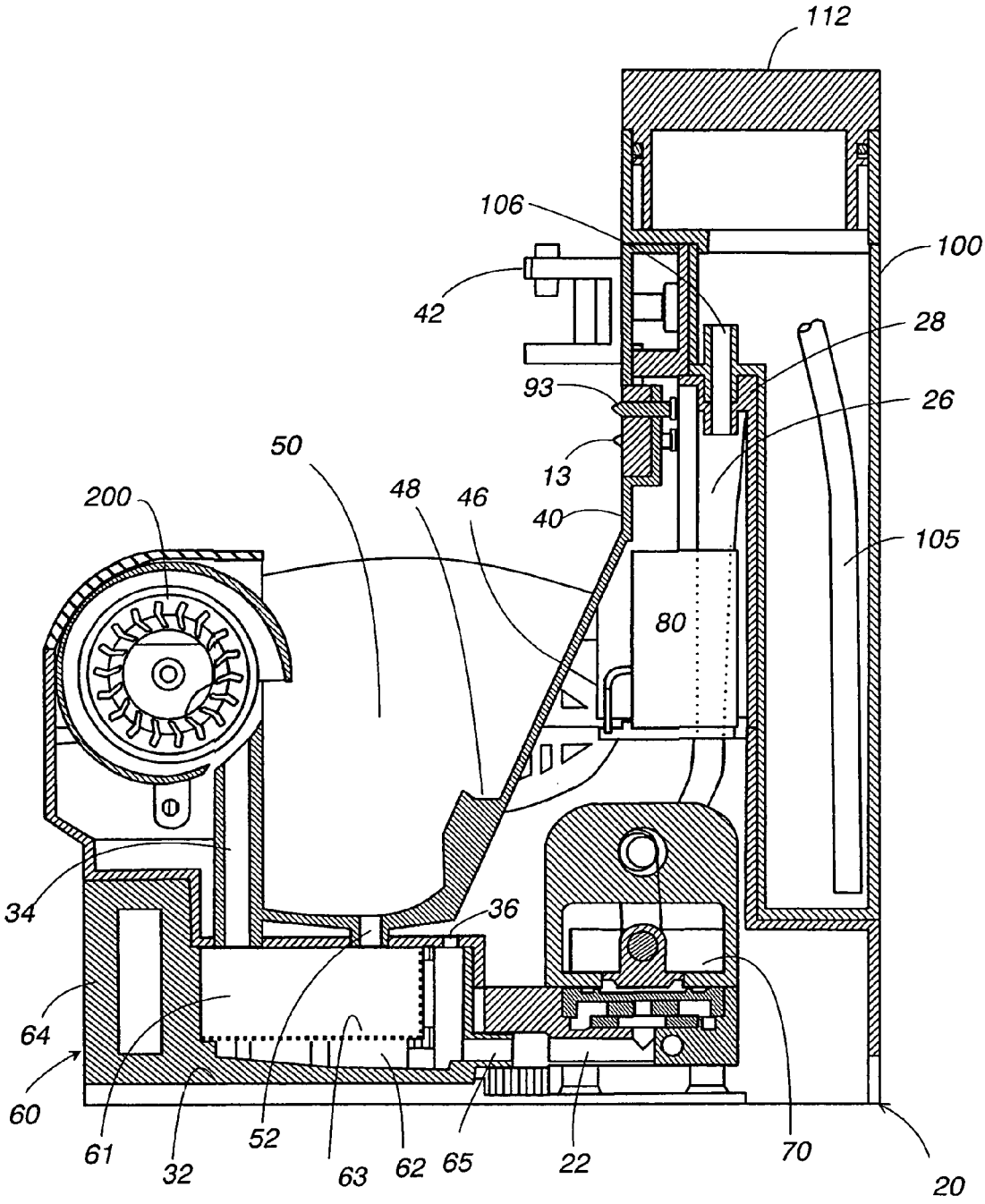

As shown in FIGS. 7 to 9, the stand 40 has a front face which is configured to guide the apparatus 10 to a holding position where the shaver head 12 is received within the basin 50. For this purpose, the front face has is a guide face 46 which is inclined with respect to a vertical or height axis of the housing 20 and which is formed at its lower end with a stopper 48 for abutting against a shoulder of the apparatus or shaver 10. The stopper 48 is positioned so that the apparatus 10 is caused to lean upon the front face of the stand by its own weight, thereby urging the pads 13 of the receiving terminal 11 against the contacts 93 of the transmitting terminal 91 for reliable electrical contact therebetween. In this sense, the electrical connection can be made successfully even without relying upon the springs 43 of the clasps 42.

Figure 16:
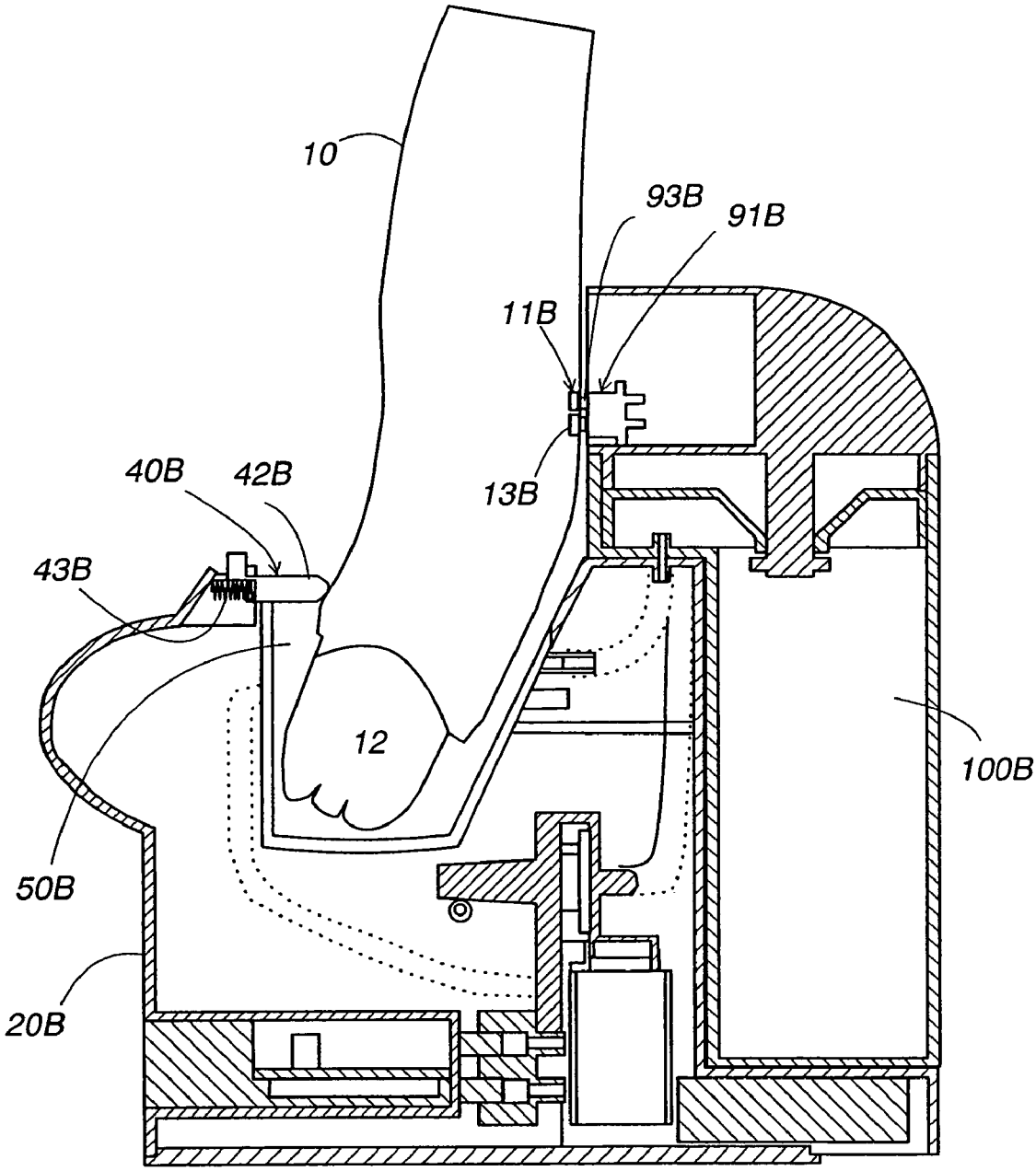
FIG. 16 is a vertical section of a cleaning device in accordance with a further modification of the above embodiment.

FIG. 16 shows a modification of the above system in which the housing 20 carries a holding means 40B in the form of a pushing unit that includes a pusher 42B movably supported by the housing 20. The pusher 42B is normally biased by a spring 43B to have its end abutted against the shaver 10, thereby holding the shaver in position and at the same time developing a contact pressure between the signal transmitting terminal 91B of the housing 20 and the signal receiving terminal 11B of the shaver for reliable electrical interconnection therebetween. In this modification, like parts are designated by like reference numerals with a suffix letter of "B".

Figure 14:
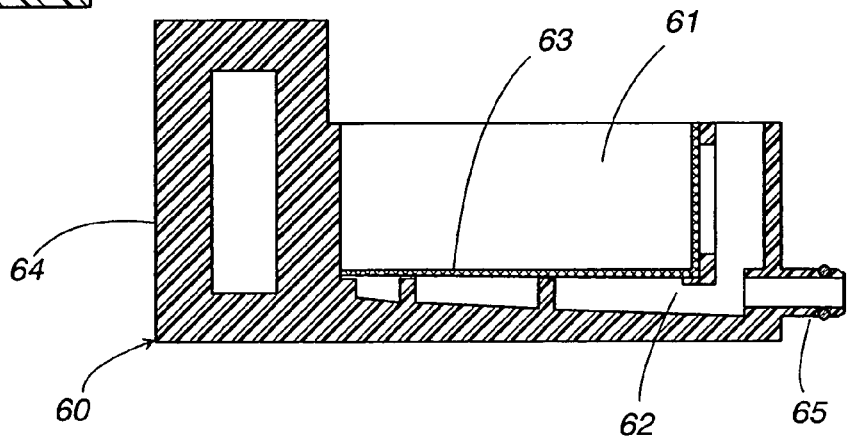
FIG. 14 is a vertical section of the drip pan.

The drip pan 60 is made detachable to the housing 20 for easy cleaning of the filter 63 as well as the pan 60 itself. As shown in FIGS. 7, 8, and 14, the drip pan 60 is provided in the form of a drawer having a front handle 64 and the top opening which comes into fluid communication with the drain port 52 of the basin 50, the air vent 36, and the overflow duct 34 for receiving the liquid and/or the air therethrough. A recess 32 is formed at the front end of the base 30 immediately below the basin 50 to accommodate the drip pan 60. The inner bottom of the pan 60 is inclined downwardly towards the connection port 65 for smoothly guiding the liquid to the fluid intake channel 22. As shown in FIG. 14, the interior space of the drip pan 60 is divided by the filter 63 into a first chamber 61 and a second chamber 62. The first chamber 61 is in direct open communication with the drain port 52 and the overflow duct 34 for collecting the liquid and/or the air respectively therethrough, thereby depositing the contaminants carried by the liquid on the filter 63. The second chamber 62 is in direct open communication with the air vent 36 and with the connection port 65 for feeding the liquid cleared of the contaminants as well as the outside air into the fluid intake channel 22. For this purpose, the filter 63 is bent into an L-shaped section, as shown in FIG. 14. The pan 60 is formed with an electrode (not shown) which is sensed by the filter detector to determined the presence of the pan in the recess 32. The drip pan 60 is designed to have a liquid storing capacity larger than that of the basin 50 in order to collect the entire volume of the liquid from the basin 50 even if the pump 70 should stop during the supply mode. The filter is preferred to have a filtering area of 700 $mm^2$ or more. Further, instead of providing the removable drip pan 60, the filter 63 alone may be detachable to the housing for frequent cleaning purpose.

The cleaning system in accordance with the present invention can be equally applied for cleaning the epilating head of a hand-held epilator or other operator head of similar hair removing apparatus.

The invention claimed is:

1. A cleaning system comprising a hair removing apparatus and a cleaning device, said apparatus having a height and an operator head at its top end, said apparatus incorporating an externally controllable electric circuit for driving said operator head and/or charging said apparatus in accordance with an external electric signal, said cleaning device comprising:

a housing configured to hold said apparatus in an inverted manner;

a basin formed in said housing for accommodating therein said opemtor head;

a tank provided on the housing to contain a volume of a cleaning liquid, a supplying means for supplying the cleaning fluid from said tank to said basin for cleaning the operator head;

a controller for activating said supplying means as well as for providing said electric signal, said housing being formed with a signal transmitting means for transmitting said electric sianal, said hair removing apparatus having a signal receiving means which comes into electrical interconnection with said signal transmitting means for giving said electric signal to said electric circuit when said apparatus is held by said housing;

wherein said signal transmitting means is disposed at a portion of the housing upwardly of said basin, and said signal receiving means is disposed intermediate the height of said apparatus, said housing is provided with holding means which holds the apparatus in a position where said signal transmission means is kept in electrical interconnection with said signal receiving means.

said holding means includes a mechanism that gives a bias for urging said signal transmitting means towards said signal receiving means, and said housing has a bearing surface for bearing said apparatus, said bearing surface being inclined with respect to a height axis of said housing and being provided with a stopper for engagement with a portion of the apparatus such that the apparatus is guided along the inclined bearing surface and develops the bias force by its own weight when it is engaged with the stopper.

* * * * *